US005666094A

United States Patent [19]

Kato et al.

[11] Patent Number: 5,666,094

[45] Date of Patent: Sep. 9, 1997

[54] METHOD OF FABRICATING NRD GUIDE CIRCUIT AND NRD GUIDE CIRCUIT

[75] Inventors: Shigeki Kato; Hiroshi Uematsu; Ken-Ichi Ogawa, all of Wako, Japan

[73] Assignee: Honda Giken Kogyo Kabushiki Kaisha, Tokyo, Japan

[21] Appl. No.: 547,376

[22] Filed: Oct. 24, 1995

[30] Foreign Application Priority Data

Oct. 25, 1994 [JP] Japan ..... 6-260710
Jul. 26, 1995 [JP] Japan ..... 7-190878

[51] Int. Cl.[6] ..... H01P 1/00

[52] U.S. Cl. ..... 333/248; 333/254

[58] Field of Search ..... 333/239, 248

[56] References Cited

U.S. PATENT DOCUMENTS 3,761,845 9/1973 Ajoika et al. ..... 333/248 X
5,473,296 12/1995 Ishikawa et al. ..... 333/239
5,604,469 2/1997 Ishikawa et al. ..... 333/248 X

FOREIGN PATENT DOCUMENTS 58-215804 A 6/1982 Japan .
57-166701 A 10/1982 Japan .
63-185101 A 7/1988 Japan .
07094915 A 4/1995 Japan .

*Primary Examiner*—Paul Gensler
*Attorney, Agent, or Firm*—Lyon & Lyon LLP

[57] ABSTRACT

An NRD guide circuit is assembled by arranging, on a lower conductive plate, a positioning member of a material (e.g., foaming styrol resin, foaming urethane or the like) having a dielectric constant smaller than that of a dielectric strip, followed by placing such component parts of the NRD guide circuit as a dielectric strip at a position delimited by the positioning member, whereafter an upper conductive plate is secured thereto.

22 Claims, 11 Drawing Sheets

Charge in the transmission characteristics resulting from the provision of a foam material when the state without the foam material is set to a reference (0dB)

METHOD OF FABRICATING NRD GUIDE CIRCUIT AND NRD GUIDE CIRCUIT

BACKGROUND OF THE INVENTION

1. Field of the Invention

The present invention relates to an NRD guide circuit employing a nonradiative dielectric waveguide (hereinafter "NRD guide") circuit and a method of fabricating such NRD guide circuit.

2. Description of the Related Art

An NRD guide comprising dielectric strips inserted between parallel, opposed conductive plates and an NRD guide circuit using such an NRD guide are known from publications such as Japanese Patent Publication No. SHO 62-35281 and Japanese Patent Laid-Open Publication No. SHO 58-215804, Japanese Patent Laid-Open Publication No. SHO 63-185101 and Japanese Patent Laid-Open Publication No. HEI 7-94915.

Reference is made to FIGS. 10A and 10B in which the structure of a conventional FM radar module employing the NRD guide circuit is shown, and to FIG. 11 in which a conventional method for assembling the FM radar module is illustrated.

In the FM radar module 80 shown in FIGS. 10A and 10B, various kinds of circuit component parts, such as an FM signal generator 83, an isolator (circulator) 84, a non-reflective terminal circuit 85, a mixer circuit 86 and an antenna block 87, are disposed in respective predetermined positions between a pair of parallel, opposed upper and lower conductive plates 81, 82. Reference numeral 90 denotes a horn of a transmitter-receiver antenna.

The FM radar module 80 is assembled using positioning jigs in the following manner. First, positions at which to dispose component parts (a dielectric strip forming an NRD guide circuit element, an electromagnetic wave absorber, a dielectric strip line and the like) are determined using a plurality of positioning jigs 91, 92, 93 made of bronze or aluminum. Next, the component parts are placed at their respective positions with their bottom surfaces (those contacting the lower conductive plate 82) coated with a cyano adhesive. Upon solidification of the adhesive, the positioning jigs 91, 92, 93 are then removed by pulling them upwardly. Thereafter, the upper conductive plate 81 is secured thereto.

However, in such conventional method of assemblage, the adhesive will ooze out from between the component parts and stick to the positioning jigs with the result that the removing operations with respect to the positioning jigs becomes difficult to carry out. Further, since it is not possible to accurately determine the positions for the component parts via the positioning jigs with the adhesive stuck thereto, the stuck adhesive should be removed and repaired before the jigs are reused, resulting in an increased number of operations.

It is therefore an object of the present invention to provide an NRD guide circuit and a method of fabricating such NRD guide circuit, which is suited for mass producing such circuits, which does not require positioning jigs that need to be removed after fabrication of the circuits, and in which the positions for the component parts can be delimited without being restricted by the manners in which the parts are positioned.

SUMMARY OF THE INVENTION

The foregoing object is met by a method of fabricating an NRD guide circuit according to the present invention, comprising the steps of arranging on a lower conductive plate at least one positioning member of a material having a dielectric constant smaller than that of a dielectric strip, then positioning the dielectric strip at a position delimited by the positioning member, and thereafter securing an upper conductive plate thereto.

An NRD guide circuit according to the present invention comprises a pair of parallel, opposed upper and lower conductive plates, at least one positioning member disposed between the conductive plates, and a dielectric strip disposed at a position, delimited by the positioning member, between the conductive plates, the positioning member being made of a material having a dielectric constant smaller than that of the dielectric strip.

Since the positioning member is made from a material having a dielectric constant smaller than that of the dielectric strip, an influence to be exerted upon the electric characteristics of the module by insertion of the positioning member will be minimum. Thus, the positioning member need not be removed after assemblage of the module. As a result, the configuration of the positioning member may be determined in light of its positioning function only, thus making it possible to cope with cases where the parts arrangement is complex.

Also, since the positions at which to place the component parts are delimited by the positioning member, it is possible to assemble the NRD guide circuit without using an adhesive. Further, even in a case where the adhesive is used, the control of the coating amount of the adhesive and the adhesive strength can be alleviated.

Even where a heater and the like is employed for maintaining an oscillating circuit and the like at a predetermined temperature, it is possible to alleviate the electrical power for producing the required heat by providing the positioning member as a heat keeping structure which covers the oscillating circuit and the like.

BRIEF DESCRIPTION OF THE DRAWINGS

Embodiments of the present invention will now be described in detail, by way of example only, with reference to the accompanying drawings, in which.

DETAILED DESCRIPTION

Figure 1:
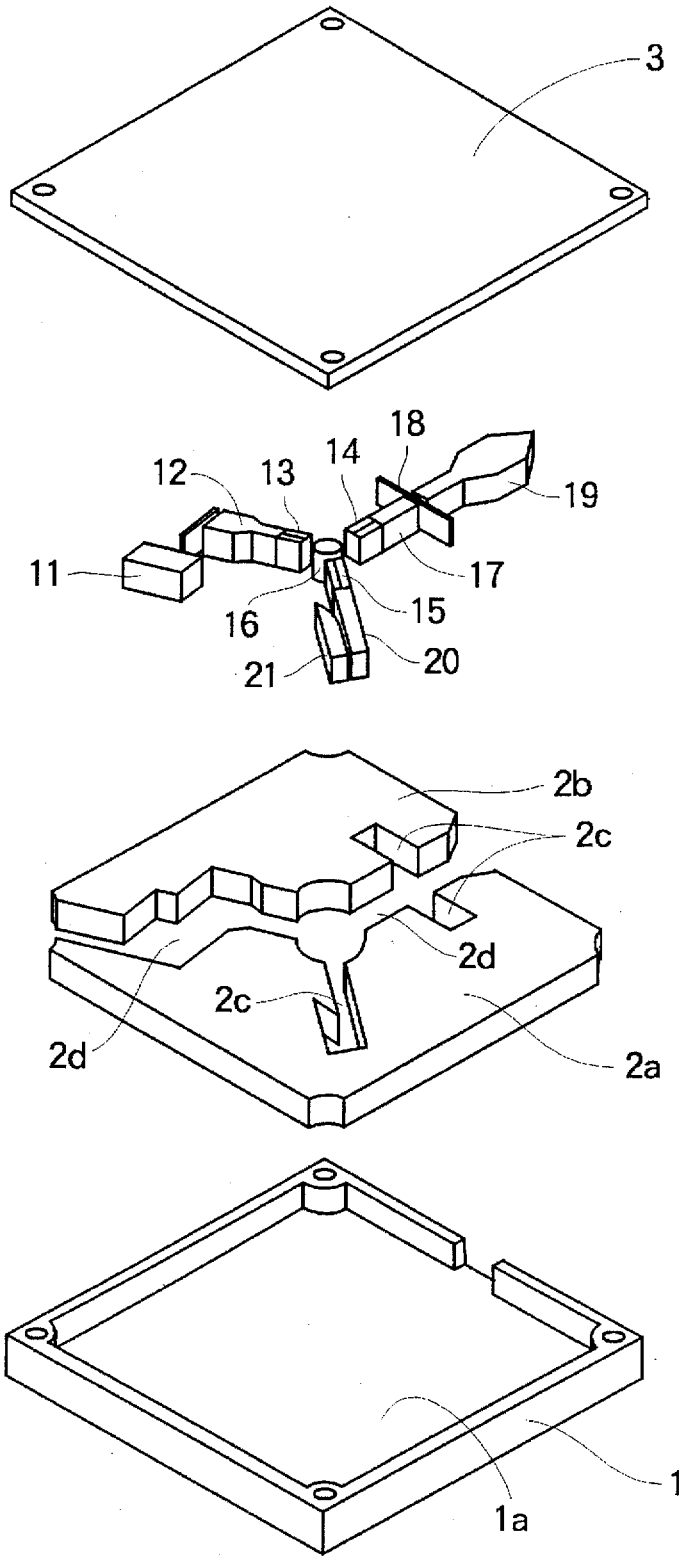
FIG. 1 is a view illustrating a method of fabricating an NRD guide circuit (FM radar module) in accordance with the present invention.
Figure 2:
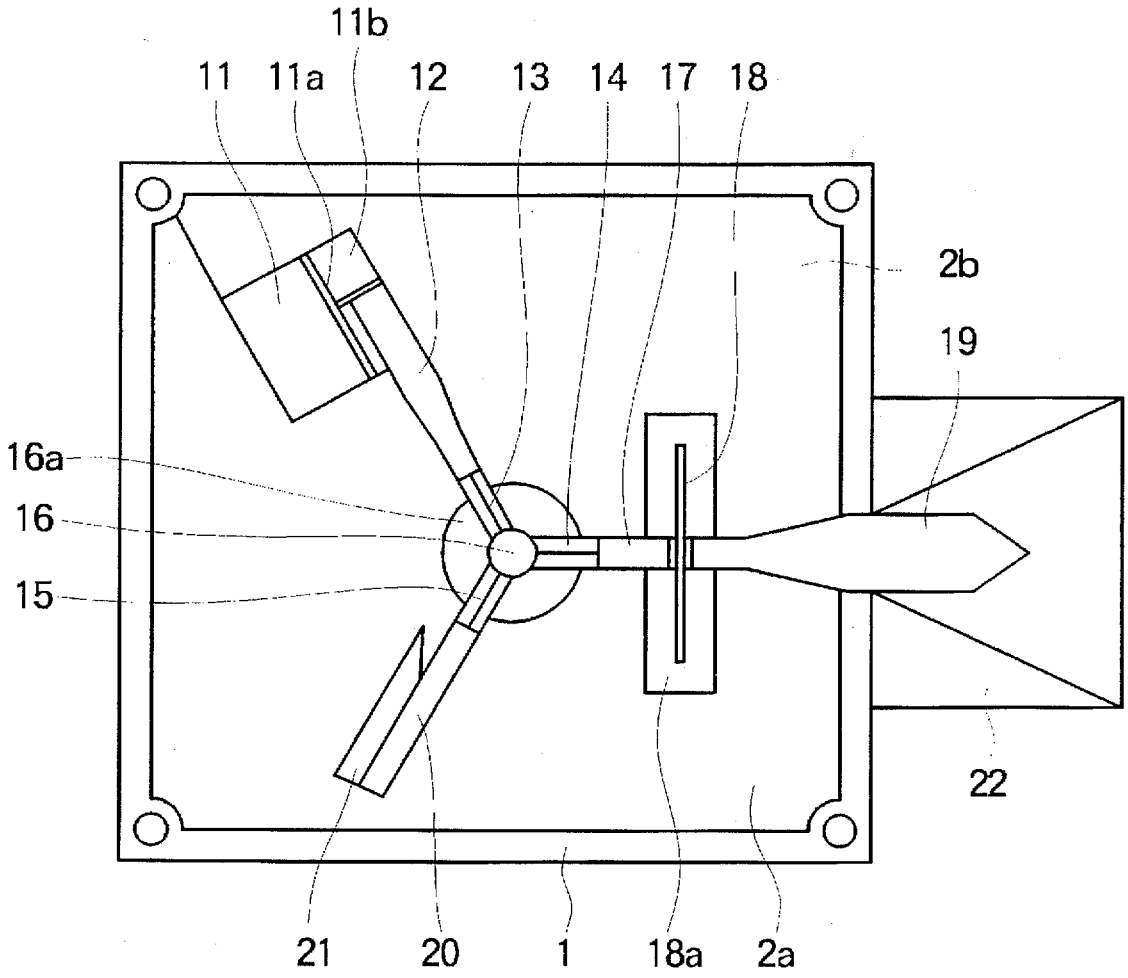
FIG. 2 is a plan view of an NRD guide circuit (FM radar module) in accordance with the present invention.

Reference is made initially to FIG. 1 illustrating a method of fabricating an NRD guide circuit according to the present invention and to FIG. 2 showing, in top plan, an NRD guide circuit according to the present invention. It should be appreciated that the views show an FM radar module as one example of the NRD guide circuit of the present invention and that in FIG. 2, it is shown with an upper conductive plate omitted.

In FIG. 1, reference numeral 1 denotes a lower conductive plate, which has four side walls and a bottom wall to form a box-like configuration. In a recessed portion 1*a* of the lower conductive plate, positioning members 2*a*, 2*b* are arranged. The positioning members 2*a*, 2*b* are made of a material having a dielectric constant smaller than the dielectric constant of the dielectric strip, such as, for example, a foaming styrol resin, a foaming urethane and the like. The positioning members 2*a*, 2*b* are adapted to delimit positions for arranging the component parts, and this can be accomplished by providing openings or slits 2*c*, or separate members, for allowing insertion of the component parts. Thus, these members are suitably configured to define spaces 2*d* therebetween for allowing arrangement or placement of the parts.

Referring to FIG. 2, the positioning members 2*a*, 2*b* are placed on a lower conductive plate 1 to provide therebetween an arrangement space for accommodating the component parts. Then, parts arrangement operation is performed by placing each component part in a respective portion of the arrangement space. Thereafter, attachment of an upper conductive plate 3 is performed, thereby completing the assemblage operation.

As just explained, by means of the positioning members 2*a*, 2*b*, an arrangement position for the component parts 11–21 is determined and the component parts 11–21 are fixed thereat, whereby an NRD guide circuit assemblage operation becomes easy and mass production of the NRD guide circuit is enabled. It also becomes possible to fabricate the NRD guide circuit without using an adhesive.

In FIGS. 1 and 2, reference numeral 11 denotes a high frequency signal generator such as a voltage controlled high frequency generator (VCO) and can be an FM signal generator provided with a Gunn oscillator. Designated by 12 is a dielectric strip which constitutes a input side line. Reference numerals 13–15 denote mode suppressors for preventing conversion of the dissipation mode. Represented by 16 is a ring with upper and lower discs, a central member of a circulator. Numeral 17 represents a dielectric strip which constitutes an output side line. 18 represents a mixer circuit employing a mixer diode. 19 represents an antenna block. Designated by 20 is a dielectric strip which forms a straight line or linear part of a non-reflective terminal circuit. 21 represents an electromagnetic wave absorber which forms the non-reflective terminal circuit. Designated by 22 is a metal horn.

No part of the positioning members 2*a*, 2*b* but air is present in a region 11*b* surrounding the periphery of a microstrip line 11*a* of the FM signal generator 11, in a region 16*a* surrounding the periphery of the central member 16 of the circulator and in a region 18*a* surrounding the periphery of the mixer circuit 18 so that the frequency characteristics may be improved.

Figure 3:
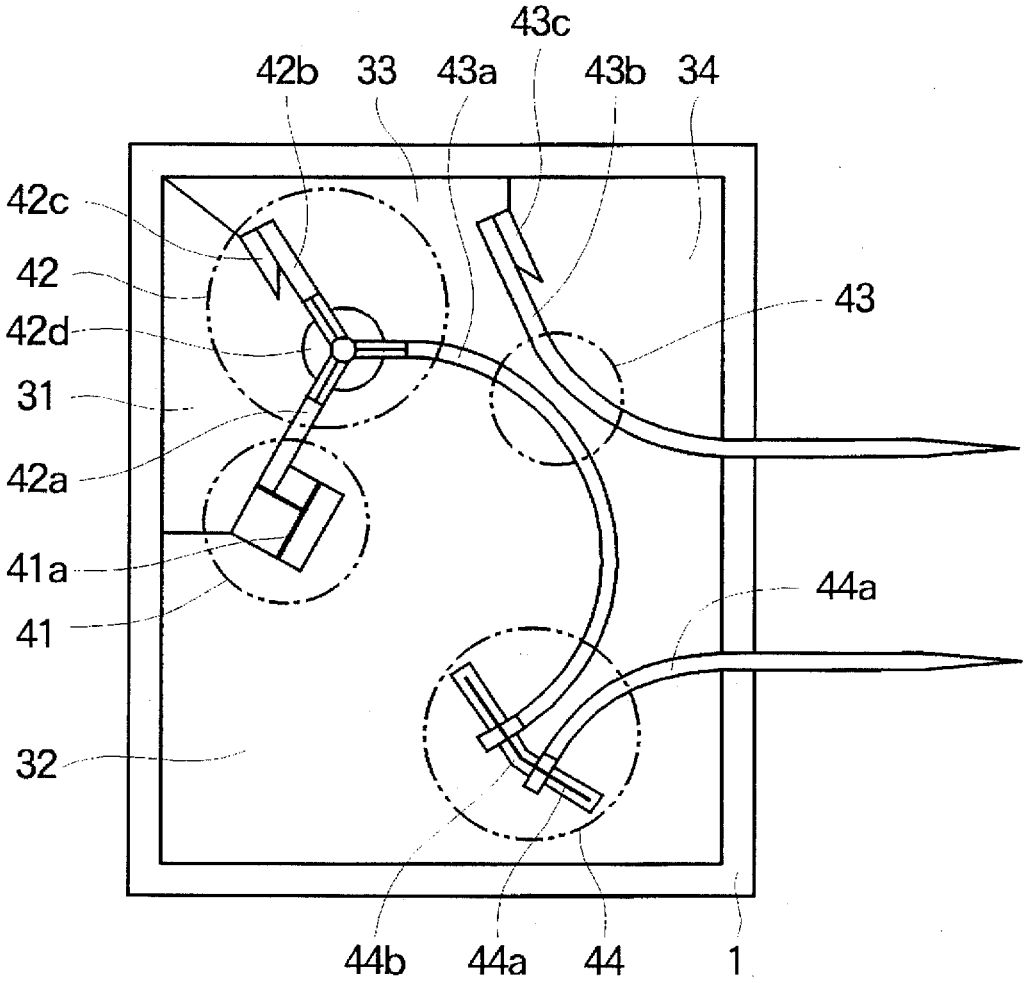
FIG. 3 is a plan view of another NRD guide circuit (circuit module) according to the present invention.

FIG. 3 is a plan view of another NRD guide circuit module according to the present invention. The FM radar module shown in FIG. 3 uses four positioning members 31–34 of a foam material to delimit and fix the arrangement position for each of the dielectric strips 42*a*, 42*b*, 43*a*, 43*b*, 44*a* and the like, which constitute an FM signal generator 41, an isolator 42, a coupler 43, a mixer circuit 44 and the like. Reference numerals 42*c* and 43*c* denote electromagnetic wave absorbers. No part of the positioning members 31–34 but air is present in a region 42*d* surrounding a central part of the isolator 42, in a region surrounding the microstrip line 41*a* of the FM signal generator 41 and in a region 44*b* surrounding a substrate 44*a* employing a mixer diode of the mixer circuit 44, so that the high frequency characteristics may be improved.

The positioning members 31–34 may be integrally formed so that the positioning may be effected by a single positioning member. Further, where the shape of the positioning member becomes complicated, the number of division of the positioning member may be increased, in which instance each positioning member may be shaped to render its fabrication easy.

Although not shown in the drawing figures, the lower conductive plate 1 may be provided with projections or recesses for locking engagement with corresponding recesses (or holes) and projections that may be formed on the positioning members 31–34, whereby the arranging positions may be delimited easily.

Figure 4A:
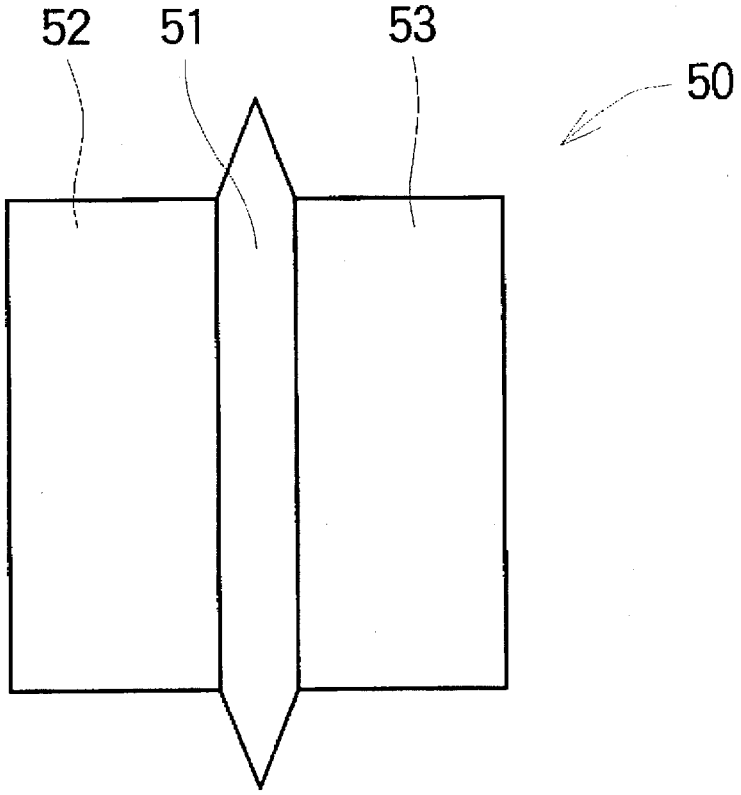
FIG. 4A and FIG. 4B are views illustrating the structure of the linear part of the NRD guide circuit according to the present invention.
Figure 4B:
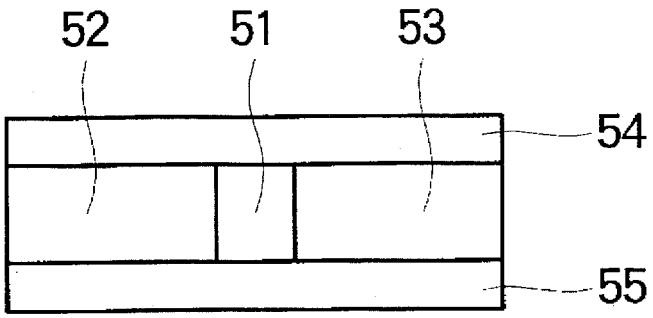
Figure 5:
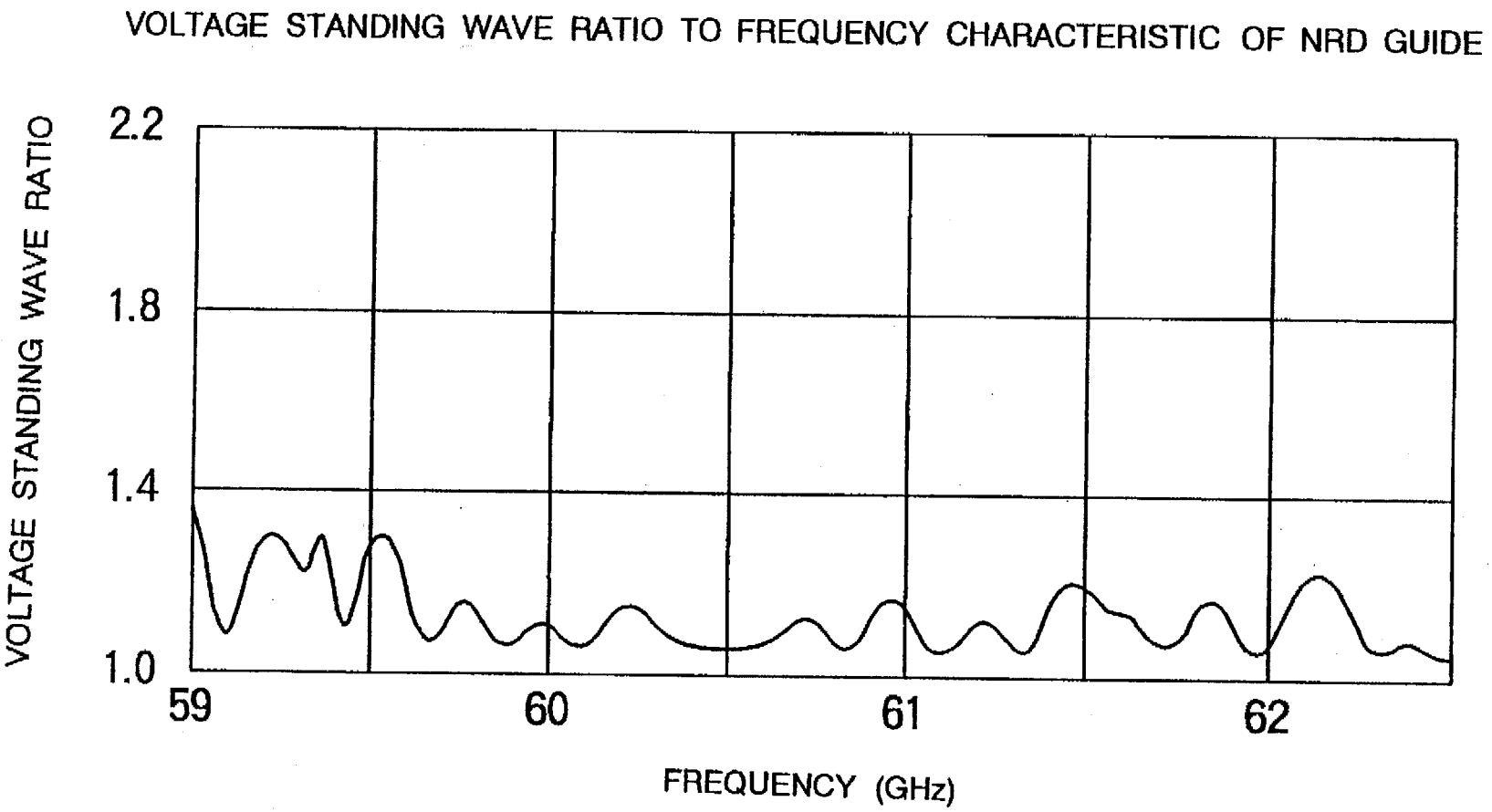
FIG. 5 is a graph showing the frequency characteristics of the voltage standing wave ratio at the linear part of the NRD guide shown in FIG. 4A and FIG. 4B.

Reference is now made to FIGS. 4A and 4B which illustrate the structure of the linear line part (42*a*, 42*b*, etc. of FIG. 3) of the NRD guide according to the present invention, and to FIG. 5 which is a graph showing the frequency characteristics of a voltage to standing wave ratio of the linear part of the NRD guide. FIG. 4A shows a state in which upper and lower conductive plates are removed. The linear part 50 is provided with foam materials 52 and 53 as positioning members on both sides of the linear line like dielectric strip 51. Reference numerals 54 and 55 denote the upper and lower conductive plates. Even when the foam materials 52 and 53 are provided, the voltage to standing wave ratio (VSWR) of the linear part 50 of the NRD guide is 1.3 or less which does not cause practical problems. The material used to form the dielectric strip 51 is a PFA (tetrafluoroethylene-fluoro-alkylvenylether copolymer), and the line length is 80 millimeters. As the foam material, foaming styrol is used.

Figure 6:
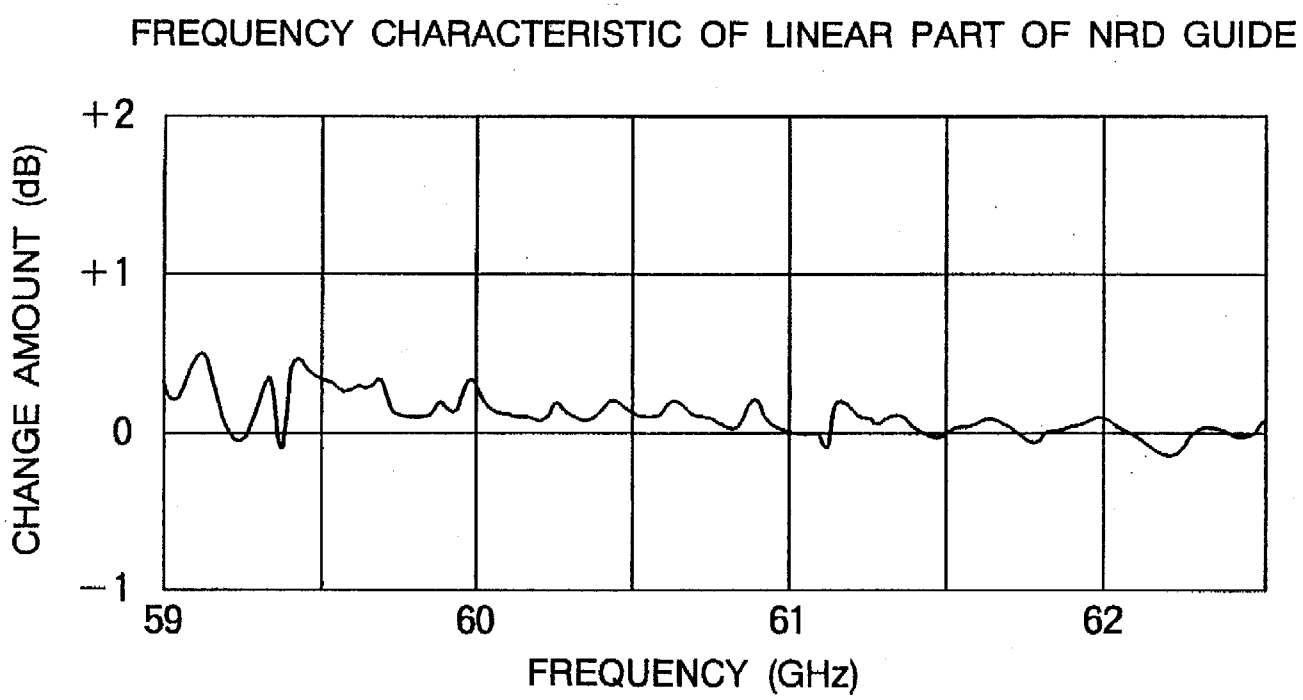
FIG. 6 is a graph showing the frequency characteristics of the transmission loss at the linear part of the NRD guide shown in FIG. 4A and 4B.

FIG. 6 is a graph showing the frequency characteristics of the linear part of the NRD guide. The graph shows a change amount of the transmission characteristics obtained by providing the foam materials 52, 53 shown in FIG. 4A, on the basis of the standards with respect to the state in which the foam materials 52, 53 are not provided as positioning materials. Even when the foam materials 52, 53 are provided as positioning materials, the transmission loss is on the level free from the problem compared with the ambient air.

Figure 7:
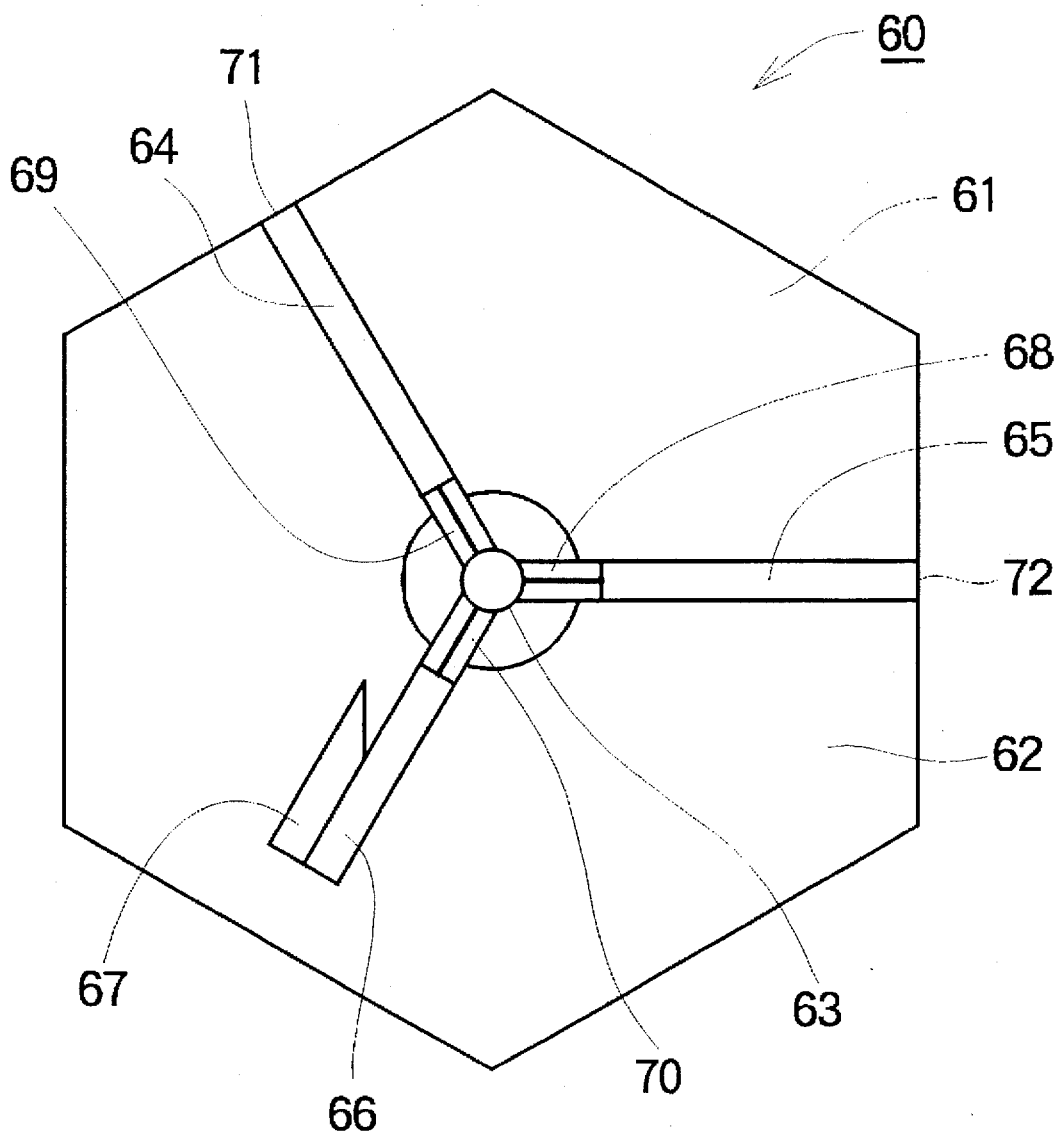
FIG. 7 is a view illustrating the structure of an isolator according to the present invention.
Figure 8:
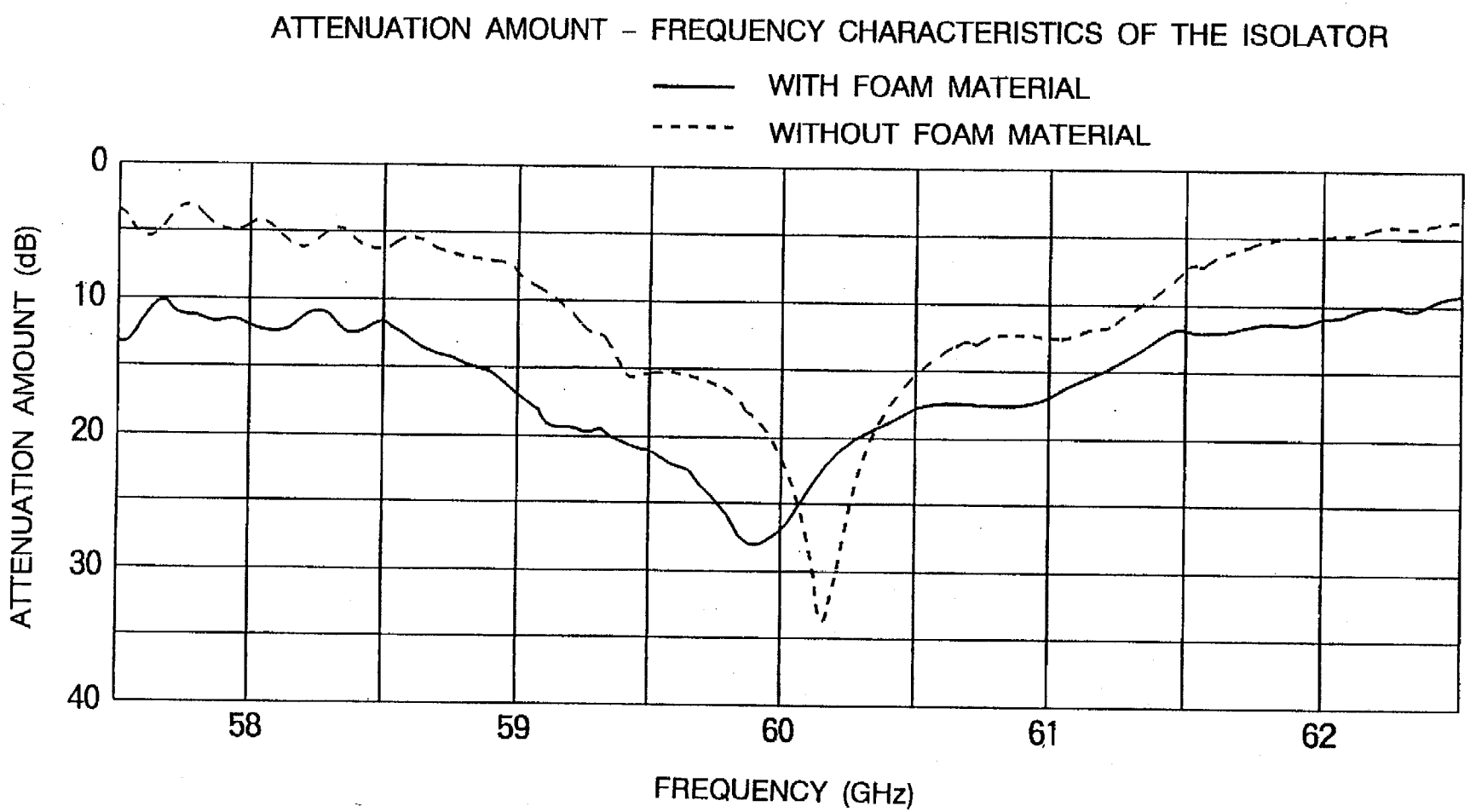
FIG. 8 is a graph showing the frequency characteristics of the attenuation amount of the isolator shown in FIG. 7.

Turning now to FIG. 7 which illustrates the structure of an isolator of the present invention, with the upper and lower conductive plates removed, the isolator 60 delimits the arrangement position of each component part by two positioning foam materials 61, 62. Reference numeral 63 denotes a ring provided with a ferrite disc on an upper and lower part thereof. Designated by 64 and 65 are an input side line and an output side line. Designated by 66 and 67 are a linear line constituting a non-reflective terminal circuit, and an electromagnetic wave absorber. 68 through 70 designate mode suppressors. The isolator 60 efficiently transmits a high frequency signal supplied from the input part 71 and at the same time prevents transmission of a high frequency signal supplied from the output part 72 to the input part 71. FIG. 8 shows a graph illustrating the frequency characteristics of the attenuation amount of the isolator. The axis of abscissa represents the frequency while the axis of ordinate represents an attenuation amount (loss reaching from the output part 72 to the input part 71). A straight line represents the characteristics of one which uses positioning foam materials 61 and 62 while a dotted line represents one which does not use positioning foam materials 61, 62 (conventional constituent part). With one which uses positioning foam materials 61, 62, an attenuation amount of 15 decibel or more can be obtained over a range of a frequency of 59 to 61 gigahertz. Further, an attenuation amount of 20 or more decibel can be obtained over a range of a frequency of 59.4 to 60.5 gigahertz. The level is favorable for an isolator in the range of 60 gigahertz.

Figure 9:
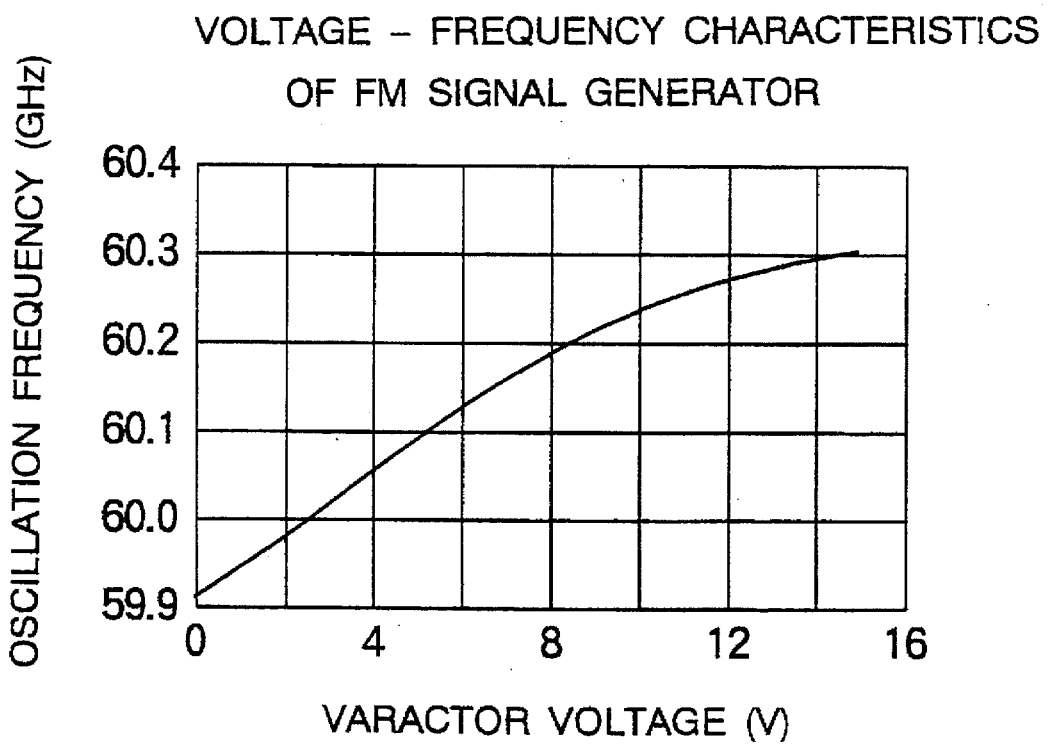
FIG. 9 is a graph showing the voltage-to-frequency characteristics of the FM signal generator shown in FIG. 2.
Figure 10A:
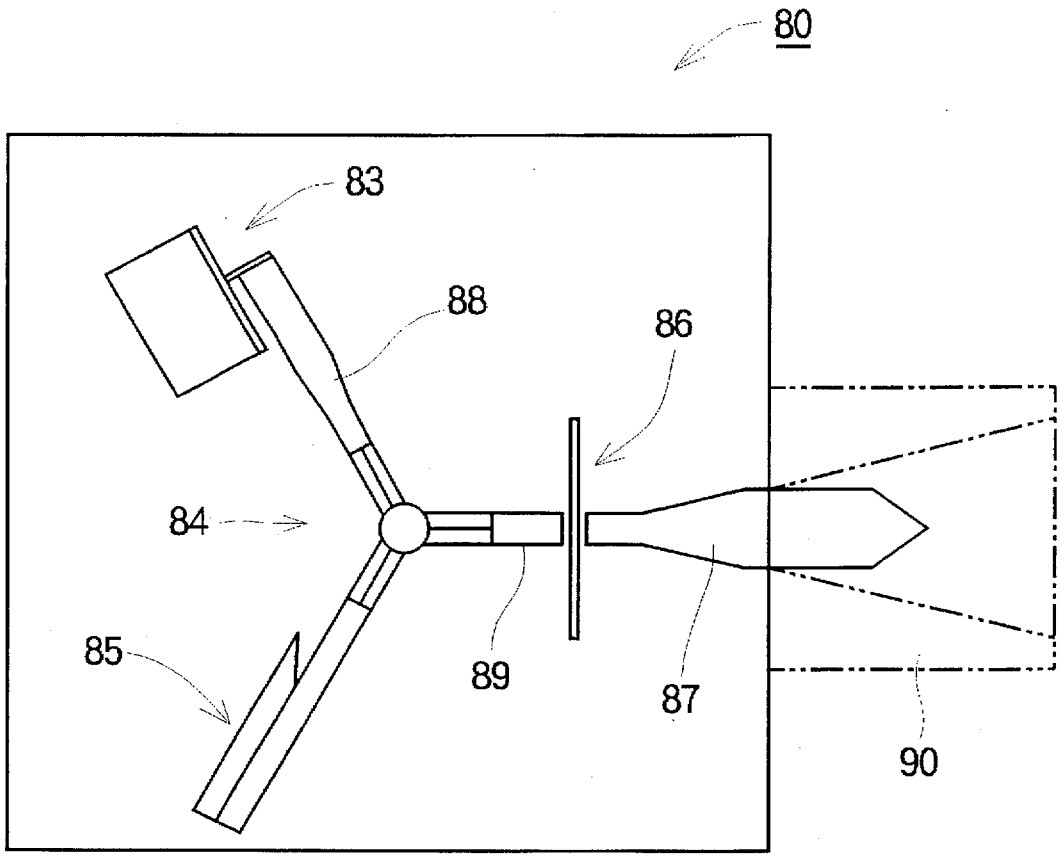
FIG. 10A (PRIOR ART)
FIG. 10A and FIG. 10B are views illustrating the structure of a conventional FM radar module formed by use of an NRD guide circuit.
Figure 10B:
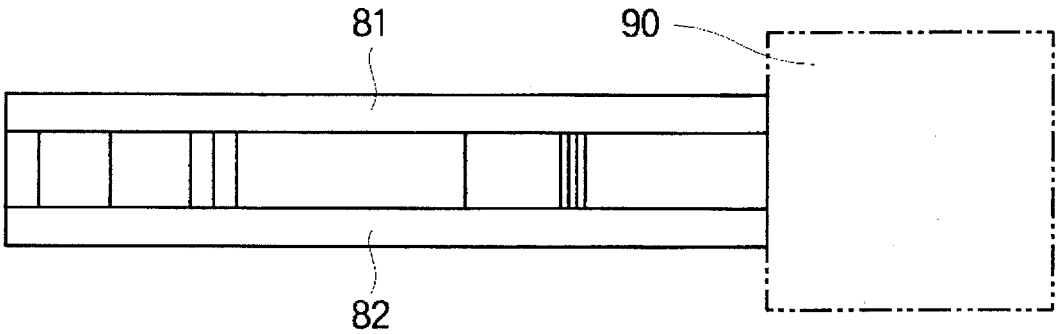
FIG. 10B (PRIOR ART)
Figure 11:
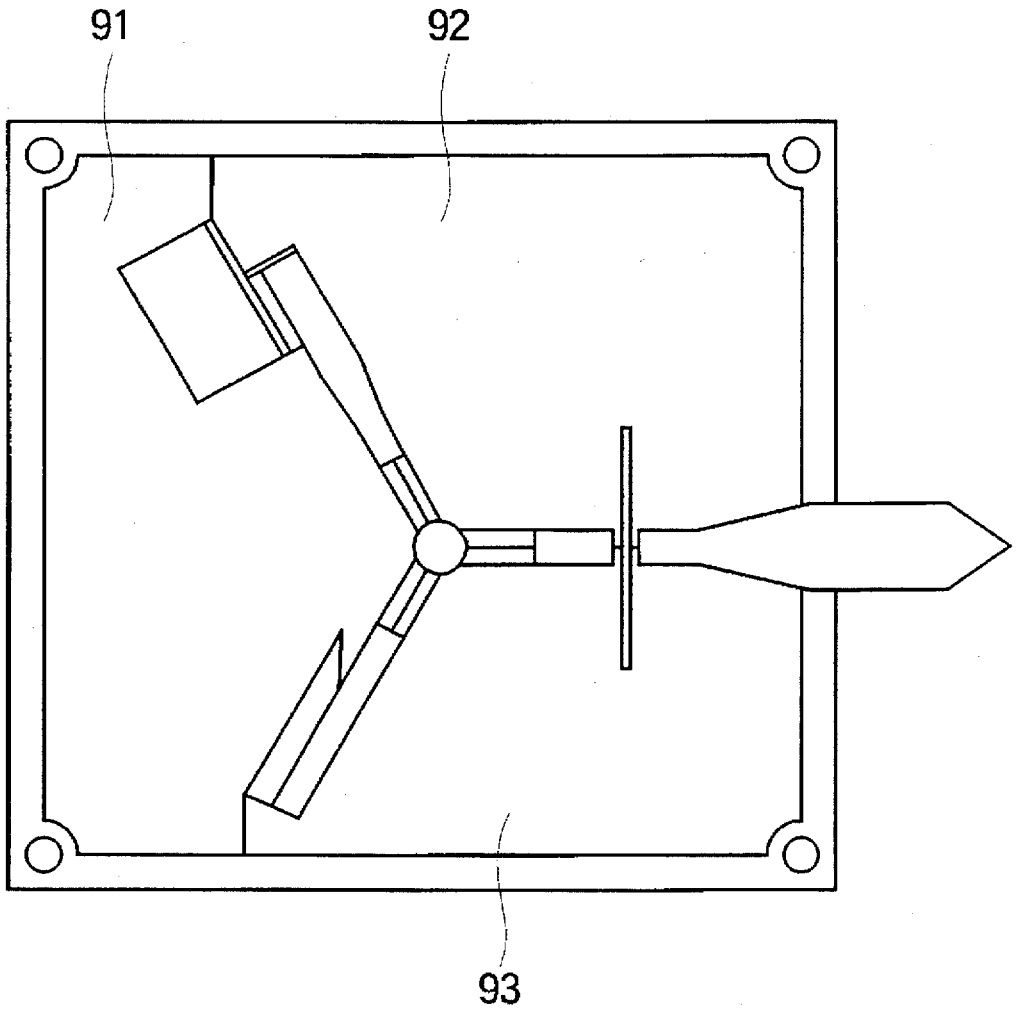
FIG. 11 (PRIOR ART)
FIG. 11 is a view illustrating a conventional method of fabricating the FM radar module.

FIG. 9 is a graph showing the voltage to frequency characteristics of the FM signal generator shown in FIG. 2. As shown in FIG. 2, even when a foam material is provided on the periphery of the FM signal generator 11 employing a Gunn oscillator, the relations between the varactor voltage (oscillation frequency control voltage) and the oscillation frequency is favorable in linearity over a frequency range of about 200 megahertz. Consequently, even when this FM signal generator 11 is applied to a FM-CW radar, extremely favorable frequency sweep range may be obtained.

As described above, with the NRD guide circuit and the method for fabricating the same in accordance with the present invention, since each component part such as a dielectric strip may be arranged at a position delimited by the positioning member, it becomes extremely easy to package or assemble each component part such as the dielectric strip constituting a circuit element, whereby mass production is enabled.

Since the positioning member uses a dielectric material having a dielectric constant smaller than that of the dielectric material, an influence to be exerted upon the electric characteristics of the module will be extremely small even when the positioning member remain inserted. Thus, it is not necessary to remove the positioning member after the module assemblage. Consequently, the shape of the positioning member may be determined only in light of the positioning function so that the component part arrangement can be dealt with even when the arrangement is complicated.

In addition, since the arrangement position is delimited by the positioning member, it is possible to assemble the NRD guide circuit without the aid of an adhesive. Further, even when the adhesive is used, the control of the coat amount of such adhesive and the adhesive strength can be alleviated. Since each component part such as a dielectric strip and the like can be fixed with the positioning member, shifting of the component part position caused by vibration and the like can be prevented.

Further, even when a heater and the like is provided for maintaining the oscillation circuit and the like at a predetermined temperature, it is possible to reduce electrical power for producing the required heat by providing the positioning member as a temperature keeping structure which covers the periphery of the oscillation circuit and the like.

What is claimed is:

1. A method of fabricating an NRD guide circuit, comprising the steps of:

arranging on a lower conductive plate, at least one dielectric positioning member having a dielectric constant smaller than a dielectric constant of a dielectric strip;

positioning said dielectric strip at a predetermined position defined by said dielectric positioning member, a high-frequency circuit formed by said dielectric strip of the NRD guide circuit being entirely positioned on the lower conductive plate by the positioning member; and attaching an upper conductive plate on said dielectric member.

2. A method of fabricating an NRD guide circuit according to claim 1, wherein said dielectric positioning member is a foam material.

3. A method of fabricating an NRD guide circuit according to claim 1, wherein said dielectric strip is made from a tetrafluoroethylene-fluoro-alkylvenylether copolymer (PFA).

4. A method of fabricating an NRD guide circuit according to claim 1, wherein said positioning step includes the step of positioning an isolator at said predetermined position defined by said dielectric member.

5. A method of fabricating an NRD guide circuit according to claim 1, wherein said positioning step includes the step of positioning a high frequency signal generator.

6. A method of fabricating an NRD guide circuit according to claim 5, wherein said high frequency signal generator positioning step comprises the step of positioning a voltage-controlled high frequency generator.

7. A method of fabricating an NRD guide circuit according to claim 5, wherein said high frequency signal generator positioning step comprises the step of positioning an FM signal oscillator.

8. A method as in claim 1 wherein the positioning member comprises a foam material including an opening for the high-frequency circuit.

9. A method as in claim 1 wherein the positioning member comprises pieces of foam material to position the high-frequency circuit.

10. A method of fabricating an NRD guide circuit according to claim 1, wherein a plurality of dielectric members are provided for positioning the dielectric strip.

11. A method of fabricating an NRD guide circuit according to claim 1, wherein the dielectric member has an opening for defining a space for positioning the dielectric strip.

12. An NRD guide circuit comprising:

a pair of parallel, opposed upper and lower conductive plates;

at least one dielectric positioning member disposed between said upper and lower conductive plates; and a dielectric strip disposed at a position defined by said positioning member between said upper and lower conductive plates forming a high-frequency circuit positioned on one of said conductive plates and positioned entirely thereon by said positioning member, said positioning member being made from a material having a dielectric constant smaller than a dielectric constant of said dielectric strip.

13. An NRD guide circuit according to claim 12, wherein said positioning member is made from a foam material.

14. An NRD guide circuit according to claim 12, wherein said dielectric strip is made from a PFA.

15. An NRD guide circuit according to claim 12, wherein said high frequency circuit includes an isolator disposed at a predetermined position defined by said positioning member.

16. An NRD guide circuit according to claim 12 wherein said high-frequency circuit includes a high frequency signal generator disposed at a predetermined position defined by said positioning member.

17. An NRD guide circuit according to claim 16, wherein said high frequency signal generator comprises a voltage-controlled high frequency generator.

18. An NRD guide circuit according to claim 16, wherein said high frequency signal generator comprises an FM signal oscillator.

19. An NRD guide circuit according to claim 12, wherein a plurality of positioning members are disposed between said upper and lower conductive plates for defining the position of the dielectric strip.

20. An NRD guide circuit according to claim 12, wherein said positioning member includes an opening for defining the position of the dielectric strip.

21. A method of fabricating an NRD guide circuit, comprising the steps of:

arranging on a first conductive plate having walls, at least one dielectric positioning member having a dielectric constant smaller than a dielectric constant of a dielectric strip;

positioning said dielectric strip at a predetermined position defined between said dielectric positioning member, the walls facilitating positioning the dielectric positioning member on the plate; and attaching an upper conductive plate over said dielectric member.

22. An NRD guide circuit comprising:

a pair of parallel, opposed upper and lower conductive plates, at least one of which has walls for facilitating placement of a positioning member;

at least one dielectric positioning member disposed between said upper and lower conductive plates; and a dielectric strip disposed at a position defined by said positioning member between said upper and lower conductive plates, said positioning member being made from a material having a dielectric constant smaller than a dielectric constant of said dielectric strip.

* * * * *